US005160048A

United States Patent [19]

Leyden et al.

[11] Patent Number: 5,160,048

[45] Date of Patent: Nov. 3, 1992

[54] GARMENT ANTI-THEFT DEVICE

[75] Inventors: Roger J. Leyden, Willow Springs; Terrance Surma, Bloomingdale, both of Ill.

[73] Assignee: Se-Kure Controls, Inc., Chicago, Ill.

[21] Appl. No.: 814,483

[22] Filed: Dec. 30, 1991

[51] Int. Cl.[5] ..... A47F 5/00

[52] U.S. Cl. ..... 211/7; 70/59

[58] Field of Search ..... 211/4, 7, 124; 70/58, 70/59, 62

[56] References Cited

U.S. PATENT DOCUMENTS

| | | | |
|---|---|---|---|
| 1,695,517 | 12/1928 | Waldbauer | 211/124 |
| 2,868,390 | 1/1959 | McCrone | 211/124 |
| 3,317,055 | 5/1967 | Roscicki | 211/124 |
| 3,993,195 | 11/1976 | Caligiuvi | 211/7 |
| 4,300,690 | 11/1981 | Thomas | 211/4 |
| 4,640,420 | 2/1987 | McKay | 70/59 X |

*Primary Examiner*—Robert W. Gibson, Jr.
*Attorney, Agent, or Firm*—Wood, Phillips, Van Santen, Hoffman & Ertel

[57] ABSTRACT

A garment anti-theft device for captively receiving at least one clothes hanger of the type having a hook with a free distal end for receiving a support arm of a garment rack to suspend the hanger therefrom. The garment anti-theft device includes a body having at least one opening therein of a size large enough to receive a free distal end of a hook of a hanger introduced by movement of the hanger free end in a first direction into the opening. A cover is attached to the body for movement selectively between an open position and a securing position. The cover, in its position, allows the free distal end of the hanger to be directed in a first direction into the body opening so that the hanger is supported in an operative position on at least one of the support arm on a clothes rack and the body and out of the opening by movement of the free distal end of the hanger oppositely to the first direction. The cover, in its securing position, locks a hanger in an operative position, preventing the free distal end of the hanger from being moved oppositely to the first direction out of the body opening. A lock is provided for locking the cover in its securing position. The cover is of a size preventing the mouth of a hanger from receiving the cover when the cover is in the securing position. The cover can be in the securing position only when the lock is in a locked position.

20 Claims, 2 Drawing Sheets

GARMENT ANTI-THEFT DEVICE

BACKGROUND OF THE INVENTION

1. Technical Field

The present invention is directed toward devices for preventing the theft of garments, and more particularly toward a garment anti-theft device for preventing removal of hangers from a garment display rack.

2. Background Art

Clothing retailers in recent years have been overwhelmed with an increase in shoplifting of valuable garments such as designer dresses and suits. At the same time, these retailers have been facing increasing labor costs, making it more expensive to provide personnel to protect against such theft.

One particularly vexing problem has been the mass theft of garments from garment display racks. Typically, garments such as designer dresses and suits are hung on hangers which in turn are suspended from a support bar of a garment display rack. Because the hangers are easily removed from the rack, a large number of the hangers can be simultaneously removed from the rack quite easily, permitting a thief to make a quick exit from a store.

One approach to prevent such theft has been to attach the garment to one end of a cable with the other end of the cable secured in a cable lock mechanism attached to the clothes rack. While this device is justified with extremely expensive garments such as furs and fine woolen coats, the expense of the cables and the cable lock mechanism and the employee time required to attach the garments to the cable makes this device impractical for mass merchandised garments of lesser value.

Other structures such as those disclosed in Parillo, U.S. Pat. No. 3,735,875 and Shapiro, U.S. Pat. No. 3,472,385, are designed prevent the mass theft of clothing by locking the hangers to the garment display rack. Generally, these structures use a bar which is suitably locked over the top of the hangers. These structures are considered too unsightly for garment display racks and do not properly space articles hung on the rack. These structures are particulary unsuited for a certain standard form of display rack which has a support arm that extends at an angle relative to the horizontal. Moreover, these structures are not readily adapted for retrofitting on existing non-locking display racks.

Other prior art devices provide a rack with an elongated support member having a plurality of grooves extending through the support member and opening at an elongated surface. Examples are disclosed in Thomas, U.S. Pat. Nos. 4,204,601 and 4,300,690. The grooves are adapted to receive the hook of a hanger and are spaced along the support member. An elongated locking member adapted to cover the opening ends of the grooves is provided for retaining the articles in the grooves. While this structure solves some of the problems discussed above, it still has several shortcomings. Most significantly, it is easy for employees to circumvent such a structure. For example, a non-diligent employee may simply return a garment hanger by placing the hook of the hanger over the top of the locking member. Furthermore, when locking the locking member in a closed position an employee cannot be certain that the lock has engaged the locking member to secure it in place without physically trying to lift the locking member. Thus, while the locking member may appear to be locked, it may not in fact be locked. In addition, such security display racks are difficult to attach to existing display rack structure. Moreover, once the locking member is unlocked it can be difficult for the employee to grab and lift the locking member from the clothes rack. Finally, the locking member is attached to the rack to pivot about an axis transverse to the length of the rack. As a result, the locking member is cantilevered from the display rack while hangers are being inserted or removed, creating a possible hazard or obstruction in a crowded store environment.

SUMMARY OF THE INVENTION

The present invention is directed towards overcoming one or more of the problems discussed above.

A garment anti-theft device for captively receiving at least one clothes hanger of the type having a hook with a free distal end for receiving a support arm of a clothes rack to suspend the hanger in its operative position includes a body having at least one opening therein of a size large enough to receive a free distal end of a hook of a hanger introduced by movement of the hanger free distal end in a first direction into the opening. A cover is attached to the body by a structure for selective movement between an open position and a securing position. The cover, in its open position, allows the free distal end of the hanger to be directed a) in a first direction into the body opening so that the hanger is supported in a hanging position on at least one of the support arm and a clothes rack and the body and b) out of the opening by movement of the free distal end of the hanger oppositely to said first direction. The cover, in its securing position, blocks the hanger in its operative position to prevent the free distal end of the hanger from being moved oppositely to the first direction out of the body opening. A lock is provided for locking the body in its securing position.

Another aspect of the present invention is a hanger in combination with a garment anti-theft device for captively receiving the hanger. The hanger has a hook defining a mouth. A body is receivable within the mouth of the hanger for supporting the hanger in an operative position. A cover for securing the hanger on the support is operatively associated with the support. The securing cover is selectively positionable between an open position and a securing position. The securing cover and support are of a size such that the mouth of the hanger cannot receive either one and be supported in an operative position wjen the cover is in a securing position.

A third aspect of the present invention is a garment anti-theft device having a body to engage a portion of a hanger to support the hanger in an operative position. A securing structure is operatively associated with the body. The securing structure is positionable between an open position wherein the hanger is receivable within and removable from the body and a securing position wherein the hanger cannot be removed from the body. A lock has a locking position for locking the securing structure in the securing position. The securing structure can assume the securing position only with the lock in the locking position.

The garment anti-theft device of the present invention can be quickly and easily adapted to existing garment display racks to prevent mass theft of merchandise from the display racks. The garment anti-theft device is attractive and inexpensive to manufacture. Unlike some prior art devices, the cover does not cantilever significantly from the body creating a potential hazard. The garment anti-theft device prevents employees from inadvertently failing to lock it.

DETAILED DESCRIPTION OF THE PREFERRED EMBODIMENT

Figure 1:
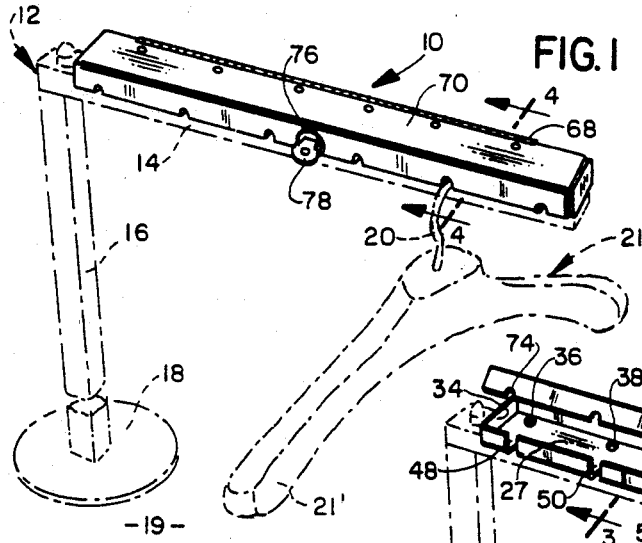
FIG. 1 is a perspective view of the garment anti-theft device of the present invention disposed on a support arm of a garment display rack with the cover of the garment anti-theft device in a securing position.

The garment anti-theft device 10 of the present invention is illustrated disposed upon a garment rack 12 in FIG. 1. The garment rack 12 comprises a support arm 14 coupled to a vertical member 16 for elevating the support arm. The vertical member is joined to a stand 18 resting upon a support surface 19. The exact configuration of the garment rack 12 herein is merely illustrative. The garment anti-theft device 10 is intended for use with any number of configurations of garment racks, including garment racks which have a support arm 12 at some angle to horizontal. Received in the garment anti-theft device 10 is a hook 20 of a hanger 21 shown with a garment support portion 21' depending therefrom in an operative position in FIG. 2.

The garment anti-theft device 10 has an elongate body 22 and a corresponding cover 24. The body 22 has a bottom wall 25, a side wall 26 and an open top 27. Preferably the side wall 26 includes an opposing front wall 28 and back wall 30, and opposing end walls 32,34 defining an elongate body of a trough-like configuration.

A plurality of openings 367,38,40,42,44,46 are spaced from each other along the elongate dimension of the bottom 26 of the elongate body 22. The openings 36,38,40,42,44,46 are located in the bottom 26 proximate the back wall 30 of the elongate body 22. A plurality of slots 48,50,52,54,56,58 are disposed in the front wall 28 of the elongate body 22. The slots 48,50,52,54,56,58 extend from the open top 27 of the elongate body 22 to the bottom 25 of the elongate body 22.

Figure 4:
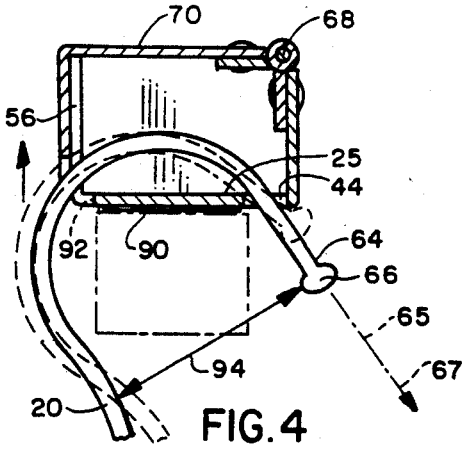
FIG. 4 is a sectional view of the garment anti-theft device of the present invention taken along line 4—4 of FIG. 1.

Each slot 48,50,52,54,56,58 corresponds to an opening 36,38,40,42,44,46, respectively. As best seen in FIG. 4, the corresponding openings and slots, as for example the opening 44 and the slot 56 illustrated in FIG. 4, are configured to receive a hook 20 of a hanger 21 therein for supporting the hanger 21 in an operative position. More particularly, the distal end 64 of the hook 20 of the hanger 21 is axially receivable in the opening 44 along the axis 65 with the hook resting in the slot 56. Preferably the distal end 64 of the hook 20 has a discontinuity 66 such as an enlargement. Alternatively, the discontinuity may be a portion of the hook bent over on the remaining portion of the hook 20 or a portion of the distal end 64 of the hood 20 bent upwards. The openings 36,38,40,42,44,46 are of a size large enough to receive the discontinuity 66 of the distal end 64 of the hook 20 only by insertion of the distal end 64 in an insertion direction indicated by the arrow 67 substantially colinear with the axis 65.

Figure 3:
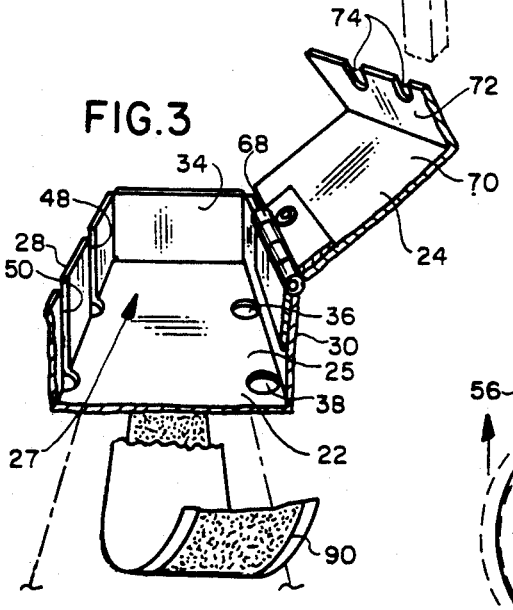
FIG. 3 is a sectional perspective view of the garment anti-theft device of the present invention taken along line 3—3 of FIG. 2.

The cover 24 is attached to the back wall 30 of the elongate body 22 by a hinge 68 which facilitates pivotal movement of the cover 24 between an open and a securing position illustrated in FIGS. 3 and 1, respectively. In the preferred embodiment, the hinge 68 connects the cover 24 and the back wall 30 of the elongate body 22 over substantially the entire elongate dimension of the elongate body 22. The cover 24 is of a length substantially equal to that of the elongate body 22. The cover 24 has a cover plate or top 70 and a front flange 72 integrally formed with the cover top 70. The cover top 70 is of a width such that when pivoted closed over the elongate body 22 as illustrated in FIGS. 1 and 4, the front flange 72 overlaps the front wall 28 of the elongate body 22. The front flange 72 also includes a plurality of slots 74, each slot corresponding to and aligned with a slot 48,50,52,54,56,58 in the front wall 28 of the elongate body 22. Each of the slots 74 is of a depth sufficient that the cover 24 may be pivoted into a closed position over the open top 27 of the body 22 with a hanger 21 disposed in one of the pairs of openings 36,38,40,42,44,46 and slots 48,50,52,54,56,58, respectively, without the front flange 72 of the cover 24 striking the hook 20 of the hanger 21.

A tubular key lock 76 is preferably disposed in the front wall 28 of the cover 24. A key 78 is shown as being disposed in the slot (not shown) of the tubular key lock 76. Attached to a shaft (not shown) of the tubular key lock 76 is a cam latch 80. The cam latch 80 pivots with rotation of the shaft by the turning of the key 78.

Figure 2:
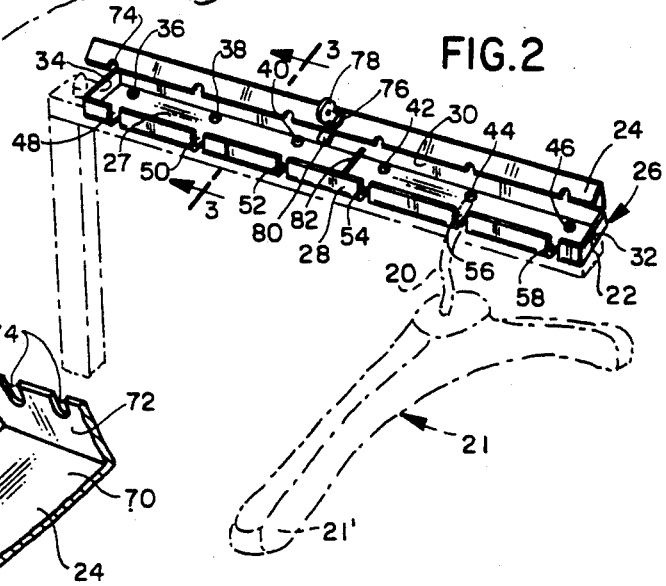
FIG. 2 is a perspective view of the garment anti-theft device of the present invention disposed on a support arm of a garment display rack with the cover of the garment anti-theft device in an open position.
Figure 5:
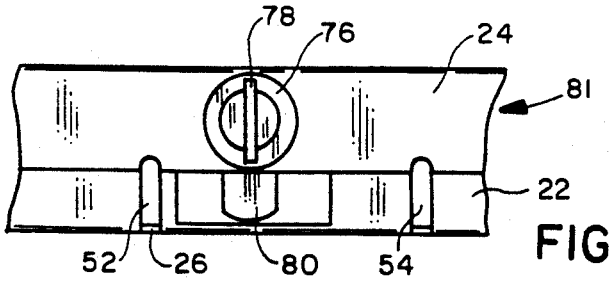
FIG. 5 is a front elevational view of a center portion of the garment anti-theft device of the present invention with the cover in a semi-closed position and the lock in an unlocked position.
Figure 6:
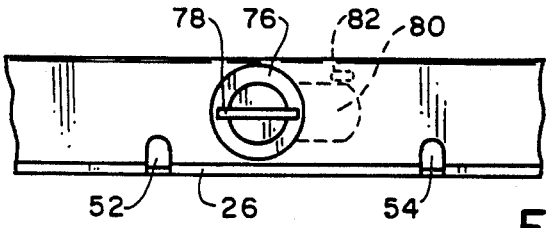
FIG. 6 is a front elevational view of a center portion of the garment anti-theft device of the present invention with the cover in a securing position and the lock in a locked position.

In FIG. 5, the cam latch 80 is shown disposed in an unlocked position. When the cam latch 80 is in the unlocked position, it is of a length sufficient that when the cover 24 is closed over the body 22 the cam latch 80 prevents the complete closure of the cover 24 by engaging the bottom 26 of the elongate body 22. In the configuration illustrated in FIG. 5, the cover is therefore in a semi-closed position 81. The cam latch 80 is also of a length sufficient that when the lock 76 is turned into a locked position, as illustrated in FIG. 6, the cam latch 80 engages a locking bar 82. As best seen in FIG. 2, the locking bar 82 extends between the front wall 28 and the back wall 30 of the elongate body 22. The cover may assume the closed position only when the lock is in the locking position.

Figure 7:
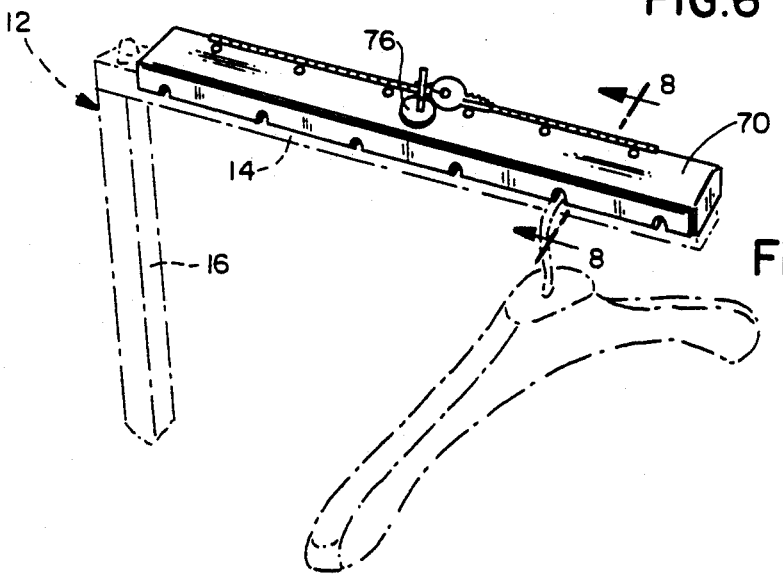
FIG. 7 is a perspective view of an alternate embodiment of the garment anti-theft device of the present invention.

In an alternate embodiment illustrated in FIG. 7, the lock 76 may be disposed in the cover top 70 of the cover 24. In this alternate embodiment, the cam latch 80 is configured to engage a stop 84 disposed on an inner surface 86 of the front wall 28 of the elongate body 22.

The outer surface 88 of the bottom 26 may be attached to the support arm 14 by any suitable means, including screws or bolts. In the preferred embodiment, the outer surface 88 of the bottom 26 is attached to the support arm 14 by a two-sided tape 90.

As illustrated, the bottom 26 of the elongate body 22 is flat, which corresponds to the flat top surface 92 of the support arm 14. If, however, the anti-theft device 10 is to be used upon a support arm 14 that does not have a flat top surface 92, such as a tubular support arm 14, the bottom 26 may be other than flat. For example, the bottom 26 may be arcuate where the support arm 14 is tubular.

Operation of the garment anti-theft device 10 is described as follows. The cover 24 can be unlocked by turning the key 78 in a clockwise direction. This in turn causes the shaft of the tubular key lock 76 to rotate in a clockwise direction, thereby causing the attached cam latch 80 to pivot in a clockwise direction. As the cam latch 80 is so pivoted, it comes in contact with the bottom 26 and cams the cover 24 into the semi-closed position illustrated in FIG. 5. In this manner, the cover 24 may be readily grasped by a user to put the cover 24 in an open position illustrated in FIG. 3. Once the cover 24 is in an open position, a hanger 21 having a hook 20 may be inserted in the body 22.

Figure 8:
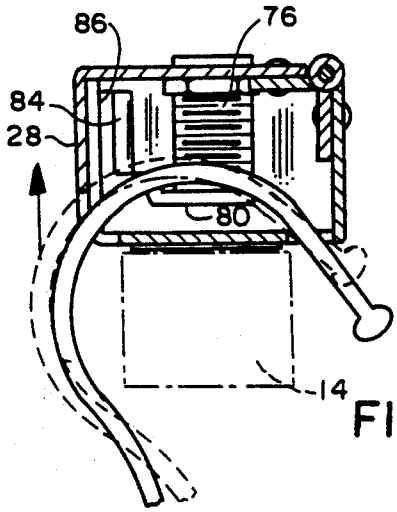
FIG. 8 is a sectional view of the alternate embodiment of the garment anti-theft device of FIG. 7 taken along line 8—8 of FIG. 7.

The hanger 21 is inserted into the body 22 of the anti-theft device 10 by inserting the hook 20 in one of the slots 48,50,52,54,56,58 in the front wall 28 of the elongate body 22. The free distal end 64 of the hook 60 is then inserted in the direction of the arrow 67 substantially along the axis 65 into an opening 36,38,40,42,44,46 corresponding to the one slot. As illustrated in FIG. 4, the hook 20 is inserted in the complementary slot 56 and opening 44. The hanger 62 is then secured in the garment anti-theft device 10 by pivoting the cover 24 into the semi-closed position illustrated in FIG. 5. Upon turning the key 78 in the counterclockwise direction, the cover 24 is cammed downward and the cam latch 80 engages the locking bar 82. Thus, the cover 24 is locked to the body 22 in a securing position as seen in FIGS. 4, 6 and 8.

When the cover 24 is locked in the securing position, a hanger 21 disposed in a complementary hole and slot is non-removably secured therein. As best viewed in FIG. 4, the hanger 21 cannot be lifted and pivoted to remove it from the anti-theft device 10. As illustrated in ghost lines in FIG. 4, when the hanger 62 is lifted and pivoted, removal of the hook 60 is blocked by the front flange 72 of the cover 24 preventing lifting of the hook 20 and the discontinuity 66 of the distal end 64 of the hook 20 preventing pivoting of the hook 20 out of the opening 44.

When the anti-theft device 10 is used in a retail clothes store environment, shortcutting of the anti-theft device 10 is prevented by several features of the anti-theft device 10. First, the width of the cover top 70 is greater than the size of the mouth 94 of the hook 20 of a hanger 21 to be used with the anti-theft device 10. As a result, employees cannot merely place the hook 60 of the hanger 62 on top of the anti-theft device 10, but must open the anti-theft device 10 and insert the hanger 21 therein in the above-described manner in order to return a hanger 21 to the clothes rack 12.

After the hanger 21 has been returned to clothes rack 12 and an attempt is made to close the cover, the cover can only be put into its semi-closed position illustrated in FIG. 5. Not until the lock 76 is put into the locking position illustrated in FIG. 6, will the cam latch 80 pivot to engage the locking bar 82 bringing the cover 24 into a securing position and locking the cover 24 into a securing position. Thus, the cover 24 can only assume the securing position with the lock 76 in the locking position. In this manner, employees can readily tell whether or not the anti-theft device 10 is locked after a garment has been returned. Moreover, the key 78 cannot be removed from the lock 76 until the cam latch 80 is fully brought into its locking position illustrated in FIG. 6.

The garment anti-theft device of the present invention is readily adaptable to a variety of commercially available garment display racks and provides a hanger securing device to prevent the mass theft of merchandise from a garment display rack. The unique front mounting of the anti-theft device lock provides a camming mechanism that facilitates opening of the cover. In addition, the camming mechanism permits a quick visual check by a user to verify whether or not the cover is locked in a securing position on the elongate body. In this manner, one using the anti-theft device cannot inadvertently put the cover in a secured position without actually engaging the locking mechanism. Finally, the width of the cover prevents either customers of inattentive employees from merely hooking a clothes hanger over the anti-theft device and thus frustrating the intended purpose of the anti-theft device.

What is claimed is:

1. A garment anti-theft device for captively receiving at least one clothes hanger of the type having a hook with a free distal end, the hook being configured to receive a support arm of a clothes rack to suspend the hanger in an operative position, the anti-theft device comprising:

a body having a top and bottom and a wall with at least one opening extending vertically therethrough of a size large enough to receive a free distal end of a hook of a hanger introduced by movement of the hanger free distal end in a first direction into the opening;

a cover;

means for attaching the cover to the body for movement selectively between an open position and a securing position, the cover, in its open position, allowing the free distal end of a clothes hanger to be directed a) in a first direction into the body opening so that the hanger is supported in an operative position on at least one of a support arm on a clothes rack and the body and b) out of the opening by movement of the free distal end of the hanger oppositely to said first direction, the cover in its securing position blocking a hanger in its operative position so as to prevent a free distal end of a hanger in the operative position from being moved oppositely to the first direction out of the body opening; and means for locking the cover to the body in its securing position.

2. A garment anti-theft device for captively receiving at least one clothes hanger of the type having a hook with a free distal end, the hook being configured to receive a support arm of a clothes rack to suspend the hanger in an operative position, the anti-theft device comprising: a body having at least one opening therein of a size large enough to receive a free distal end of a hook of a hanger introduced by movement of the hanger free distal end in a first direction into the opening;

a cover;

means for attaching the cover to the body for movement selectively between an open position and a securing position, the cover, in its open position, allowing the free distal end of a clothes hanger to be directed a) in a first direction into the body opening so that the hanger is supported in an operative position on at least one of a support arm on a clothes rack and the body and b) out of the opening by movement of the free distal end of the hanger oppositely to said first direction, the cover in its securing position blocking a hanger in its operative position so as to prevent a free distal end of a hanger in the operative position from being moved oppositely to the first direction out of the body opening; and means for locking the cover to the body in its securing position, wherein the body has an elongate bottom wall, an open top, and a peripheral side wall defining a trough-like structure, the opening being in the bottom wall of the body, the cover, when in its securing position, covering at least part of the open top to prevent lifting of a hanger out of the body opening.

3. A garment anti-theft device for captively receiving at least one clothes hanger of the type having a hook with a free distal end, the hook being configured to receive a support arm of a clothes rack to suspend the hanger in an operative position, the anti-theft device comprising:

a body having at least one opening therein of a size large enough to receive a free distal end of a hook of a hanger introduced by movement of the hanger free distal end in a first direction into the opening;

a cover;

means for attaching the cover to the body for movement selectively between an open position and a securing position, the cover, in its open position, allowing the free distal end of a clothes hanger to be directed a) in a first direction into the body opening so that the hanger is supported in an operative position on at least one of a support arm on a clothes rack and the body and b) out of the opening by movement of the free distal end of the hanger oppositely to said first direction, the cover in its securing position blocking a hanger in its operative position so as to prevent a free distal end of a hanger in the operative position from being moved oppositely to the first direction out of the body opening; and means for locking the cover to the body in its securing position, wherein the attaching means comprises a hinge facilitating pivotable movement of the cover between its open and its securing positions.

4. The garment anti-theft device of claim 2 wherein the peripheral side wall has a slot being spaced from the opening a distance such that a hook of a hanger can rest in the slot with a distal end of the hook received in the opening.

5. The garment anti-theft device of claim 2 wherein the bottom wall is rectangular and the peripheral side wall comprises two pairs of opposing side walls.

6. The garment anti-theft device of claim 5 comprising a plurality of openings in the bottom wall spaced along the elongate dimension of the body, a side wall corresponding to the elongate dimension of the body having a slot corresponding to each opening, each slot extending downward from the open top of the body and spaced from its corresponding opening a distance such that a hook of a hanger can rest in each slot with a distal end of the hook received in the corresponding opening.

7. The garment anti-theft device of claim 5 wherein the cover is connected to the side wall along a portion of the side wall corresponding to the elongate dimension of the body.

8. The garment anti-theft device of claim 7 wherein the cover comprises a cover plate with a downwardly extending flange for overlapping a portion of the side wall opposite the portion of the side wall to which the cover is connected when the cover is in the securing position, the flange preventing lifting of a hook of a hanger, thereby preventing movement of a hook of a hanger inserted in a hole through the bottom of the body oppositely the first direction.

9. The garment anti-theft device of claim 8 wherein the slots are in the portion of the side wall opposite the portion of the side wall to which the cover is connected, the flange blocking at least a portion of each slot thereby preventing lifting of the hook and movement of the free distal end of the hanger oppositely to the first direction.

10. The garment anti-theft device of claim 3 wherein the lock comprises a cam pivotable between a locked and an unlocked position, the cover being able to assume the securing position only when the cam is pivoted into the locked position.

11. The garment anti-theft device of claim 1 wherein the hook has a mouth to receive a support arm, the cover has a width, and with the cover in a securing position, the hooked mouth of a hanger cannot receive the width of the cover.

12. A garment anti-theft device for captively receiving at least one clothes hanger of the type having a hook with a free distal end, the hook being configured to receive a support arm of a clothes rack to suspend the hanger in an operative position, the anti-theft device comprising:

a body having at least one opening therein of a size large enough to receive a free distal end of a hook of a hanger introduced by movement of the hanger free distal end in a first direction into the opening;

a cover;

means for attaching the cover to the body for movement selectively between an open position and a securing position, the cover, in its open position, allowing the free distal end of a clothes hanger to be directed a) in a first direction into the body opening so that the hanger is supported in an operative position on at least one of a support arm on a clothes rack and the body and b) out of the opening by movement of the free distal end of the hanger oppositely to said first direction, the cover in its securing position blocking a hanger in its operative position so as to prevent a free distal end of a hanger in the operative position from being moved oppositely to the first direction out of the body opening; and means for locking the cover to the body in its securing position, there being in combination with the garment anti-theft device a clothes rack having a support arm suspended above a support surface, the garment anti-theft device further comprising double-sided tape for connecting the body to the support arm.

13. A combination hanger and garment anti-theft device for captively receiving the hanger, said combination comprising:

a hanger having a garment support portion and a hook defining a mouth for suspending the hanger in an operative position in which the garment support portion depends from the hook;

means on the garment anti-theft device receivable within the mouth of the hanger for supporting the hanger in an operative position; and means for securing the hanger on the supporting means operatively associated with the supporting means, the securing means being selectively positionable between a) an open position wherein the mouth of the hanger may freely receive and disengage the supporting means and b) a securing position wherein the mouth of the hanger receiving the supporting means is prevented from disengaging the supporting means, the supporting means and the securing means, with the securing means in the securing position, being of a size such that the mouth of the hanger cannot receive either of the securing means and supporting means so as to maintain the hanger in its operative position.

14. A combination hanger and garment anti-theft device for captively receiving the hanger, said combination comprising:

a hanger having a hook defining a mouth for suspending the hanger in an operative position;

means receivable within the mouth of the hanger for supporting the hanger in an operative position; and means for securing the hanger on the supporting means operatively associated with the supporting means, the securing means being selectively positionable between a) an open position wherein the mouth of the hanger may freely receive and disengage the supporting means and b) a securing position wherein the mouth of the hanger receiving the supporting means is prevented from disengaging the supporting means, the supporting means and the securing means, with the securing means in the securing position, being of a size such that the mouth of the hanger cannot receive either of the securing means and supporting means and be suspended thereby in an operative position, wherein the supporting means comprises an elongate bottom wall, an open top and a peripheral side wall defining a trough-like structure, the bottom wall having at least one opening of a size large enough to receive a free distal end of the hook of the hanger introduced by movement of the hanger free distal end in a first direction.

15. The combination of claim 14 wherein the means for securing comprises:

a cover;

means for attaching the cover to the body for movement selectively between an open position and a securing position wherein the cover covers the open top blocking movement of the hanger free distal end of the hanger received in the opening in a direction opposite to the first direction.

16. A garment anti-theft device for preventing removal of a hanger from a support arm of a clothes rack, the garment anti-theft device comprising:

a body for engaging a portion of a hanger to support the hanger in an operative position;

means for securing the hanger to the body in an operative position on the body, the securing means being selectively positionable between a) an open position wherein the hanger is engageable with and disengageable from the receiving body and b) a securing position wherein the hanger is not disengageable from the body;

a lock selectively positionable between a) a locking position for locking the securing means in the securing position and b) an unlocked position independently of the securing means; and cooperating means on the body and lock for allowing the securing means to assume the securing position only with the lock in the locking position.

17. A garment anti-theft device for preventing removal of a hanger from a support arm of a clothes rack, the garment anti-theft device comprising:

a body for engaging a portion of a hanger to support the hanger in an operative position;

means for securing the hanger to the body in an operative position operatively associated with the body, the securing means being selectively positionable between a) an open position wherein the hanger is engageable with and disengageable from the receiving body and b) a securing position wherein the hanger is not disengageable from the body;

a lock selectively positionable between a) a locking position for locking the securing means in the securing position and b) an unlocked position; and cooperating means on the securing means and lock for allowing the securing means to assume the securing position only with the lock in the locking position, wherein the body comprises an elongate bottom wall, an open top and a peripheral side wall defining a trough-like structure, the bottom wall having at least one opening of a size large enough to receive a free distal end of a hook of the hanger introduced by movement of the hanger free distal end in a first direction.

18. A garment anti-theft device for preventing removal of a hanger from a support arm of a clothes rack, the garment anti-theft device comprising:

a body for engaging a portion of a hanger to support the hanger in an operative position;

means for securing the hanger to the body in an operative position operatively associated with the body, the securing means being selectively positionable between a) an open position wherein the hanger is engageable with and disengageable from the receiving body and b) a securing position wherein the hanger is not disengageable from the body;

a lock selectively positionable between a) a locking position for locking the securing means in the securing position and b) an unlocked position; and means for the securing means to assume the securing position only when the lock is in the locking position, wherein the mans for securing comprises a cover, and a hinge attaching the cover to the body for pivotable movement selectively between an open position and a securing position, the cover covering the open top in the securing position thereby blocking movement of a free distal end of a hanger received in the opening in a direction opposite to the first direction.

19. The garment anti-theft device of claim 18 wherein the means for the cover to assume the securing position only when the lock is in the locking position comprises a cam on the lock pivotable between a locked and unlocked position, the cam, in an unlocked position, preventing the cover from assuming the securing position by striking the bottom wall of the body before the cover can be pivoted into the securing position.

20. The garment anti-theft device of claim 1 wherein said first direction is vertically downwardly.

* * * * *